US006995720B2

(12) United States Patent
Shikata

(10) Patent No.: US 6,995,720 B2
(45) Date of Patent: Feb. 7, 2006

(54) DUAL-BAND ANTENNA WITH EASILY AND FINELY ADJUSTABLE RESONANT FREQUENCY, AND METHOD FOR ADJUSTING RESONANT FREQUENCY

(75) Inventor: Masaru Shikata, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/932,722

(22) Filed: Sep. 2, 2004

(65) Prior Publication Data

US 2005/0052323 A1 Mar. 10, 2005

(30) Foreign Application Priority Data

Sep. 5, 2003 (JP) ..... 2003-314103

(51) Int. Cl.
*H01Q 1/24* (2006.01)

(52) U.S. Cl. ..... 343/702; 343/700 MS

(58) Field of Classification Search ..... 343/702, 343/700 MS
See application file for complete search history.

(56) References Cited

U.S. PATENT DOCUMENTS 6,195,048 B1 * 2/2001 Chiba et al. ..... 343/700 MS
2003/0122718 A1 * 7/2003 Fang et al. ..... 343/702

FOREIGN PATENT DOCUMENTS

JP 10-93332 4/1998
JP 2002-158529 5/2002

* cited by examiner

*Primary Examiner*—Hoang V. Nguyen
(74) *Attorney, Agent, or Firm*—Brinks Hofer Gilson & Lione

(57) ABSTRACT

In a dual-band antenna, an insulating base is formed on a support board having a ground conductor. A first radiation conductor plate for a low band has first and second divided conductor plates for covering an opening end of the insulating base. A feed conductor plate and a first short-circuiting conductor plate are continuously formed with the first divided conductor plates. A second short-circuiting conductor plate is continuously formed with the second divided conductor plate. A second radiation conductor plate for a high band is connected with the feed conductor plate. The feed conductor plate and the second short-circuiting conductor plate are electromagnetically coupled. The second divided conductor plate has a bending flap, and the bending flap is engaged with the insulating base. The bending flap has a cutout or cutaway portion for finely adjusting the resonant frequency.

38 Claims, 3 Drawing Sheets

DUAL-BAND ANTENNA WITH EASILY AND FINELY ADJUSTABLE RESONANT FREQUENCY, AND METHOD FOR ADJUSTING RESONANT FREQUENCY

This application claims the benefit of priority to Japanese Patent Application No.: 2003-314103, filed on Sep. 5, 2003, which is incorporated herein by reference.

BACKGROUND OF THE INVENTION

1. Field of the Invention

The present invention relates to compact dual-band antennas and to a method for adjusting the resonant frequency thereof. More particularly, the present invention relates to a dual-band antenna for use in on-vehicle communication devices, capable of transmitting and receiving signal waves in two frequency bands, and to a method for adjusting the resonant frequency of the dual-band antenna.

2. Description of the Related Art

An inverted-F antenna has been used for resonance in two frequencies. One type of known dual-band inverted-F antenna has a radiation conductor plate with a cutout portion that allows for resonance at two frequencies, i.e., high and low frequencies. Such an antenna is shown in, for example, Japanese Unexamined Patent Application Publication No. 10-93332.

FIG. 6 is a perspective view of an inverted-F dual-band antenna 1 of the related art. In the dual-band antenna 1, a radiation conductor plate 2 has a rectangular cutout portion 4, and provides an L-shaped conductor strip 2*a* that is resonated at a first frequency $f_1$ and a rectangular conductor strip 2*b* that is resonated at a second frequency $f_2$ higher than the first frequency $f_1$. One side edge of the radiation conductor plate 2 is continuously formed with a short-circuiting conductor plate 3. The short-circuiting conductor plate 3 is disposed in an upright position on a ground conductor plate 5 for short-circuiting between the radiation conductor plate 2 and the ground conductor plate 5. The radiation conductor plate 2 faces the ground conductor plate 5 with a predetermined distance therebetween. A feed pin 6 is soldered at a predetermined position of the radiation conductor plate 2. The feed pin 6 is connected with a feed circuit (not shown) not in contact with the ground conductor plate 5.

In the dual-band antenna 1 of the related art, the longitudinal length of the L-shaped conductor strip 2*a* is set to about a quarter of the resonance length $\lambda_1$ corresponding to the first frequency $f_1$, and the shorter longitudinal length of the rectangular conductor strip 2*b* is set to about a quarter of the resonance length $\lambda_2$ corresponding to the second frequency $f_2$, where $\lambda_2<\lambda_1$. When predetermined high-frequency power is supplied to the radiation conductor plate 2 via the feed pin 6, the conductor strips 2*a* and 2*b* are resonated at different frequencies, and signal waves in two frequency bands, i.e., high and low frequency bands, are transmitted and received.

In dual-band antennas that can be resonated at two frequencies, i.e., high and low frequencies, it is necessary to check whether or not a desired resonant frequency is obtained before the antennas are sold. In most cases, the resonant frequency for the low frequency band (low band) needs to be finely adjusted because, in antenna devices, generally, the lower the frequency, the narrower the bandwidth at which the antenna devices can be resonated.

In the dual-band antenna 1 of the related art shown in FIG. 6, since the radiation conductor plate 2 functions as both low-band and high-band antennas, it is not easy to adjust the resonant frequency for either band. For example, if a portion of the L-shaped conductor strip 2*a* for the low band is cut out to finely adjust the resonant frequency (i.e., the first frequency $f_1$), the resonant frequency for the high band (i.e., the second frequency $f_2$) is easily affected. Thus, a careful and high-precision cutting operation is required for finely adjusting the resonant frequency of the L-shaped conductor strip 2*a*, leading to a complex frequency adjusting operation and high production cost.

SUMMARY OF THE INVENTION

In one aspect, a dual-band antenna includes a support board having a ground conductor. An insulating base is formed on the support board. A first radiation conductor plate covers an opening end of the insulating base and resonates at a first frequency. A feed conductor plate has a first end connected with the first radiation conductor plate and a second end connected with a feed circuit. A short-circuiting conductor plate has a first end connected with the first radiation conductor plate and a second end connected with the ground conductor. A second radiation conductor plate is disposed in an internal space of the insulating base and is connected with the second end of the feed conductor plate such that the second radiation conductor plate resonates at a second frequency higher than the first frequency. The first radiation conductor plate has a bending flap that is bent from the opening end towards a side wall of the insulating base. The bending flap has a cutaway portion that reduces the current path length and/or a cutout portion that increases the current path length.

In the dual-band antenna, the bending flap of the first radiation conductor plate is engaged with the side wall of the insulating base, and the first radiation conductor plate for the low band is positioned at the opening end of the insulating base. When the first radiation conductor plate is excited, a current flows in the bending flap. The bending flap has a cutaway portion at a corner that reduces the current path length, thereby increasing the resonant frequency. The bending flap has a cutout portion that causes the current to flow around this portion to increase the current path length, thereby reducing the resonant frequency. Removal of a portion of the bending flap using a tool such as a router does not affect the second radiation conductor plate for the high band. Moreover, the distribution of the current flowing in the main portion of the first radiation conductor plate that is positioned at the top surface of the insulating base cannot extremely change. Thus, even if the cutting amount or position is deviated to some extent, such a deviation does not cause a large change in the resonant frequency. Therefore, the resonant frequency for the low band is easily adjustable, and the operation efficiency greatly increases.

In another aspect, a method for adjusting a resonant frequency of a dual-band antenna is provided. The dual-band antenna includes an insulating base formed on a support board having a ground conductor; a first radiation conductor plate disposed so that an opening end of the insulating base is covered with the first radiation conductor plate, such that the first radiation conductor plate can be resonated at a first frequency; a feed conductor plate having a first end connected with the first radiation conductor plate and a second end connected with a feed circuit; a short-circuiting conductor plate having a first end connected with the first radiation conductor plate and a second end connected with the ground conductor; and a second radiation conductor plate disposed in an internal space of the insulating base so as to be connected with the second end of the feed conductor plate, such that the second radiation conductor plate can be resonated at a second frequency higher than the first frequency. In the method, a portion of the first radiation conductor plate is cut out to form a cutaway portion that reduces a current path length and/or a cutout portion that increases the current path length, thereby changing a resonant frequency of the first radiation conductor plate The resonant frequency for the low band is adjusted by cutting a portion of the first radiation conductor plate. In this case, there is little influence on the second radiation conductor plate. Therefore, only the resonant frequency for the low band may be taken into consideration during cutting, resulting in high operation efficiency.

In the method, the first radiation conductor plate has a bending flap that is bent from the opening end towards a side wall of the insulating base, and the bending flap is cut. Removal of a portion of the bending flap using a tool such as a router does not change the distribution of the current flowing in the main portion of the first radiation conductor plate that is positioned at the top surface of the insulating base by a large amount. Thus, the resonant frequency for the low band can be more easily adjusted.

The bending flap extends along a periphery of the opening end, and the bending flap is engaged with the insulating base around the side wall, thereby increasing the assembly strength of the first radiation conductor plate with respect to the insulating base and increasing the size of the bending flap to ensure the space for the cutaway portion or the cutout portion.

In the method, the bending flap may have a plurality of clearance holes for defining the amount by which the bending flap is cut out to form the cutaway portion and/or the cutout portion. In this case, the bending flap can be cut by a tool such as a router according to a desired one of the clearance holes. Thus, the resonant frequency for the low band can be easily and accurately increased or reduced, resulting in higher operation efficiency.

In the dual-band antenna of, the first radiation conductor plate for the low band has a bending flap that is bent from the opening end towards the side wall of the insulating base, and a portion of the bending flap is cut out to form a cutaway portion or a cutout portion in order to finely adjust the resonant frequency. If the cutting amount or position is deviated to some extent during the frequency adjustment, the resonant frequency does not change by a large amount. Thus, the resonant frequency for the low band is easily and finely adjustable, and the production cost is also reduced.

In the method, a portion of the first radiation conductor plate is cut out to adjust the resonant frequency for the low band. Such frequency adjustment does not appreciably affect the second radiation conductor plate for the high band. Therefore, only the resonant frequency for the low band may be taken into consideration during cutting, resulting in high operation efficiency.

DESCRIPTION OF THE PREFERRED EMBODIMENTS

Figure 1:
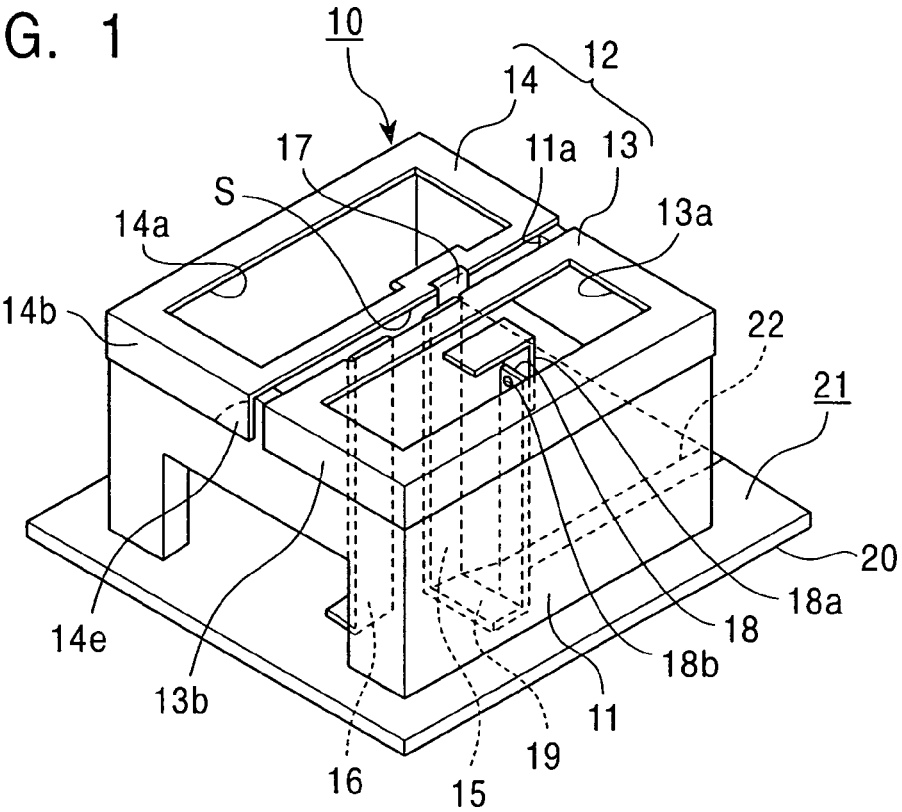
FIG. 1 is a perspective view of a dual-band antenna according to an embodiment of the present invention.
Figure 2:
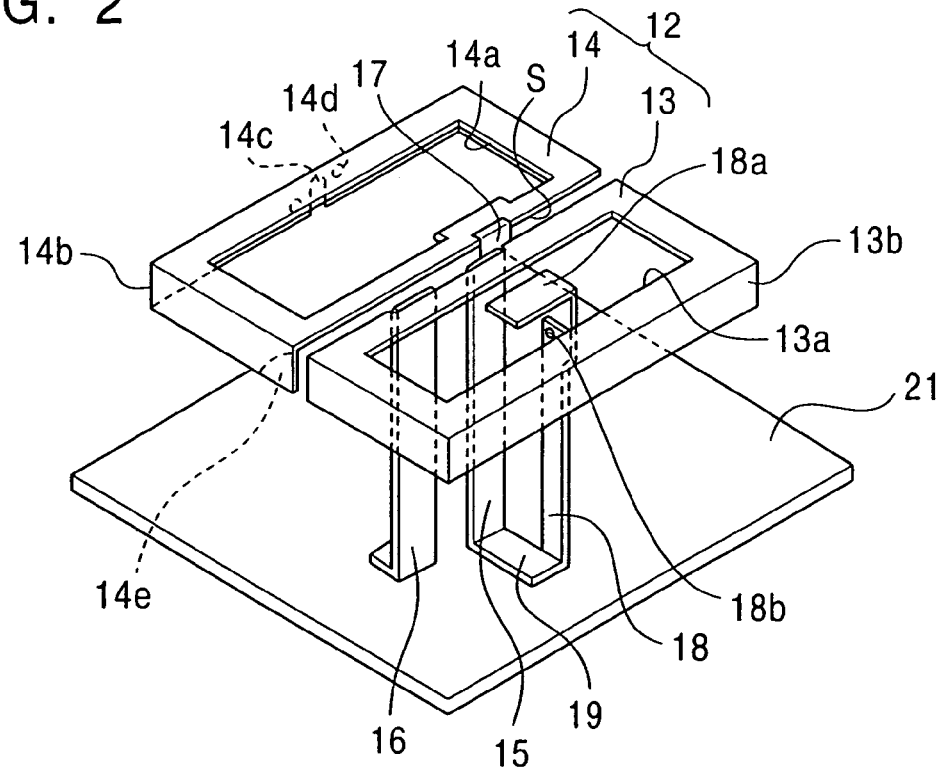
FIG. 2 is a perspective view of conductor plates of the antenna.
Figure 3:
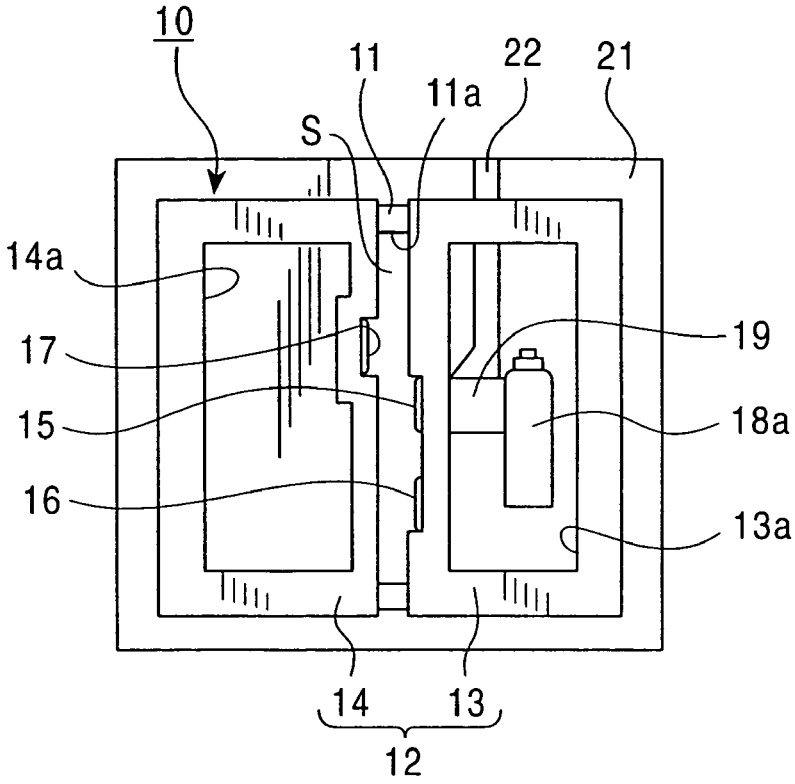
FIG. 3 is a plan view of the antenna.
Figure 4:
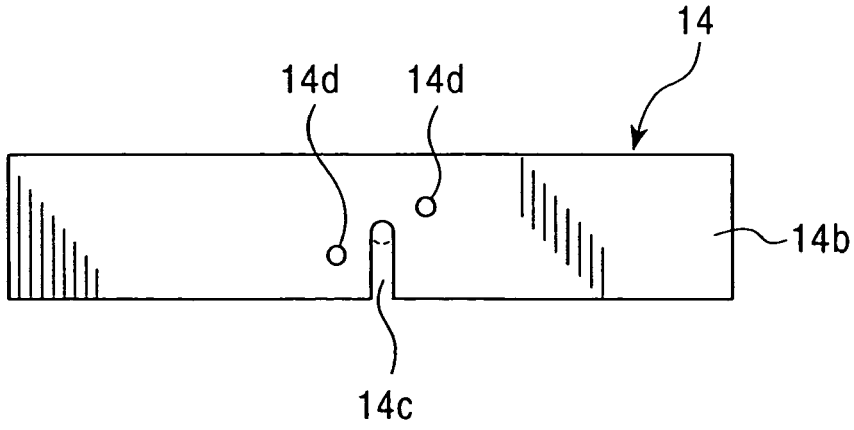
FIG. 4 is an enlarged view of the main portion showing a frequency adjusting portion of the antenna.
Figure 5:
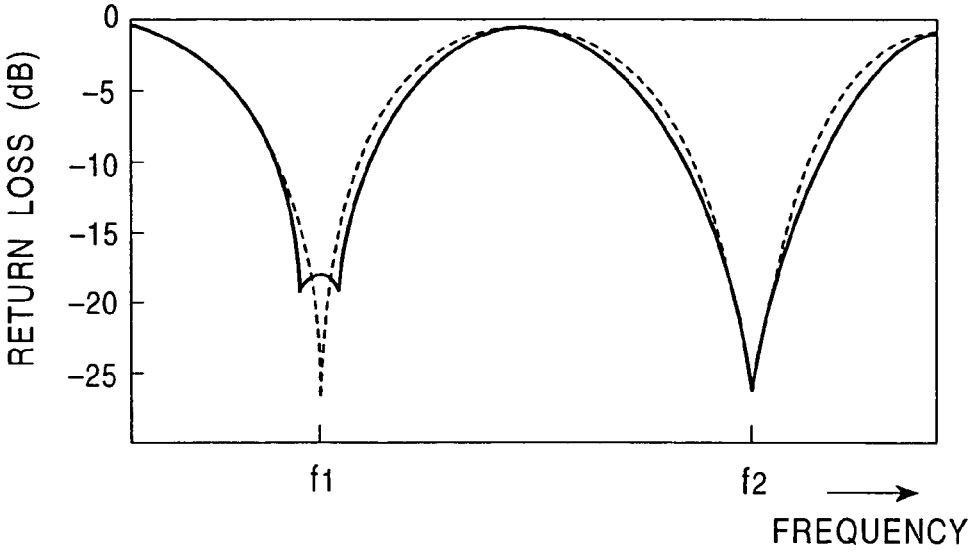
FIG. 5 is a characteristic chart showing the return loss of the antenna with respect to frequency.
Figure 6:
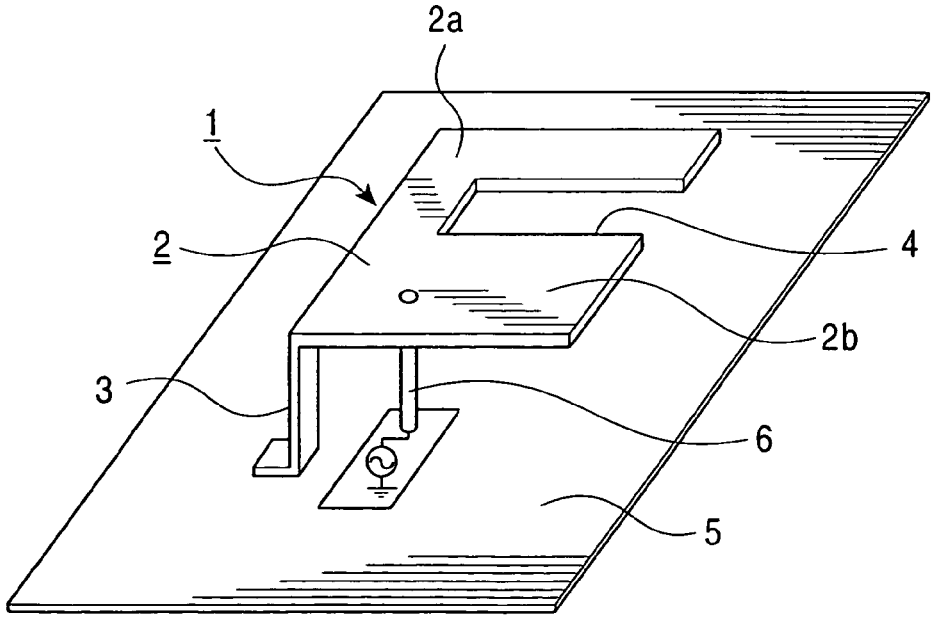
FIG. 6 PRIOR ART
FIG. 6 is a perspective view of an inverted-F dual-band antenna of the related art.

A dual-band antenna 10 according to an embodiment of the present invention will be described with reference to the drawings. FIG. 1 is a perspective view of the dual-band antenna 10, FIG. 2 is a perspective view for showing conductor plates of the antenna 10 with an insulating base removed, and FIG. 3 is a plan view of the antenna 10. FIG. 4 is an enlarged view of the main portion showing a frequency adjusting portion of the antenna 10, and FIG. 5 is a characteristic chart showing the return loss of the antenna 10 with respect to frequency.

The dual-band antenna 10 is a compact antenna device, used as an on-vehicle antenna, for example. The dual-band antenna 10 is capable of selectively transmitting and receiving signal waves in a low band (e.g., the 800-MHz AMPS band) and a high band (e.g., the 1.9-GHz PCS band).

The dual-band antenna 10 includes a support board 21 having a ground conductor 20 on the entirety of a surface opposite to the side of the dual-band antenna 10, a rectangular tubular insulating base 11 fixed to the support board 21, and a first radiation conductor plate 12 having a pair of divided conductor plates 13 and 14 formed side-by-side with a slit S therebetween covering an opening end 11*a* of the insulating base 11. The length of the dual-band antenna 10 is in the direction of extension of the slit S and the width of the dual-band antenna 10 is perpendicular to the direction of extension of the slit S.

The dual-band antenna 10 further includes a feed conductor plate 15 and a first short-circuiting conductor plate 16 that are disposed in an upright manner (i.e. substantially perpendicular to the ground plane 20) in an internal space of the insulating base 11 so that the top ends of the feed conductor plate 15 and the first short-circuiting conductor plate 16 are continuously formed with the outer edge of the divided conductor plate 13 on the side of the slit S. The dual-band antenna 10 further includes a second short-circuiting conductor plate 17 that is disposed in an upright manner in the internal space of the insulating base 11 so that the top end of the second short-circuiting conductor plate 17 is continuously formed with the outer edge of the divided conductor plate 14 on the side of the slit S, and a second radiation conductor plate 18 that is disposed in an upright manner in the internal space of the insulating base 11 so that the bottom end of the second radiation conductor plate 18 is connected with the feed conductor plate 15. The second radiation conductor plate 18 is shorter than the first radiation conductor plate 12.

The insulating base 11 is a molded part made of a dielectric material such as synthetic resin. The four corners of the insulating base 11 are fixed by screws or some other mounting means from the opposite surface of the support board 21. The first and second radiation conductor plates 12 and 18, the feed conductor plate 15, and the first and second short-circuiting conductor plates 16 and 17 are conductive plates such as copper plates. The divided conductor plate 13, the feed conductor plate 15, the first short-circuiting conductor plate 16, and the second radiation conductor plate 18 (except for an L-shaped top end portion 18*a*) are integrally formed. The divided conductor plate 14 and the second short-circuiting conductor plate 17 are integrally formed. Thus, the feed conductor plate 15 and the first short-circuiting conductor plate 16 extend downwards from the outer edge of the divided conductor plate 13, and the second radiation conductor plate 18 extends upwards from the bottom end of the feed conductor plate 15 via a bridge portion 19. The leading end of the second radiation conductor plate 18 is connected with the L-shaped top end portion 18*a* by a screw 18*b* or other fastener. The second short-circuiting conductor plate 17 extends downwards from the outer edge of the divided conductor plate 14. When the screw 18*b* is loosened, the L-shaped top end portion 18*a* is slightly slid up and down to appropriately adjust the height of the second radiation conductor plate 18.

The pair of divided conductor plates 13 and 14 of the first radiation conductor plate 12 has window portions 13*a* and 14*a* and bending flaps 13*b* and 14*b*, respectively. The bending flaps 13*b* and 14*b* extend along the periphery of the opening end 11*a* of the insulating base 11. The bending flaps 13*b* and 14*b* are bent from the opening end 11*a*, and are engaged with the insulating base 11 around the side wall thereof. The bending flap 14*b* of the divided conductor plate 14 has a cutout portion 14*c* that is formed by cutting or some other means and permits frequency adjustment, and one or more clearance holes 14*d* that define the amount by which the bending flap 14*b* is cut out to form the cutout portion 14*c*.

The feed conductor plate 15 extends from substantially the center of the outer edge of the divided conductor plate 13 on the side of the slit S. The first short-circuiting conductor plate 16 extends near the feed conductor plate 15 substantially in parallel thereto. The bridge portion 19 that connects the bottom end of the feed conductor plate 15 and the bottom end of the second radiation conductor plate 18 is soldered or otherwise connected to a feed land (not shown) on the support board 21, and the feed land is connected to a feed circuit (not shown) via a coplanar line 22.

The bottom ends of the first and second short-circuiting conductor plates 16 and 17 are connected to the ground conductor 20 via through-holes (not shown) formed in the support board 21. The second short-circuiting conductor plate 17 and the feed conductor plate 15 diagonally face each other with the slit S therebetween. When the feed conductor plate 15 is fed, electromagnetic coupling causes an induced current to flow in the second short-circuiting conductor plate 17.

In the dual-band antenna 10, the first radiation conductor plate 12 and the second radiation conductor plate 18 are selectively excited by selectively supplying power of different frequencies to the bridge portion 19.

In exciting the first radiation conductor plate 12, the divided conductor plate 14 operates as a radiating element of a parasitic antenna. Thus, by supplying power having a first frequency $f_1$, for the low band to the feed conductor plate 15, the divided conductor plate 13 is resonated in a similar manner to a radiating element of an inverted-F antenna. Moreover, the electromagnetic coupling to the divided conductor plate 13 causes an induced current to flow in the second short-circuiting conductor plate 17, and the divided conductor plate 14 is also resonated. By supplying power having a second frequency $f_2$ for the high band to the second radiation conductor plate 18, where $f_2>f_1$, the second radiation conductor plate 18 is resonated so as to operate as a monopole antenna.

FIG. 5 is a characteristic chart showing the return loss of the dual-band antenna 10 with respect to frequency, as indicated by a solid curve. Two different resonance points are exhibited in the low band. The resonant frequencies corresponding to the two resonance points are determined depending upon the relative position of the feed conductor plate 15 and the second short-circuiting conductor plate 17, that is, the electromagnetic coupling strength between the conductor plates 15 and 17. The relative position of the conductor plates 15 and 17 is appropriately designed so that the return loss at a frequency between the two resonance points is −10 dB or less, thus increasing the bandwidth for the low band. This prevents the bandwidth from being narrowed as the size is reduced.

In FIG. 5, a broken curve indicates the return loss of a comparative example in which only one resonance point is exhibited in the low band. The comparative example provides a narrower bandwidth for the low band than the present embodiment. As shown in FIG. 5, the higher the resonant frequency, the broader the bandwidth. Thus, a sufficiently broad bandwidth is obtained in the high band.

In some cases, a desired resonant frequency is not obtained during testing before the dual-band antenna 10 is sold. In such cases, the first radiation conductor plate 12 and the second radiation conductor plate 18 undergo frequency adjustment processing. If the resonant frequency in the low band deviates from the desired resonant frequency, the bending flap 14*b* of the divided conductor plate 14 is cut by a tool such as a router to form the cutout portion 14*c* or a cutaway portion 14*e*, each of which is indicated by a dotted line in FIG. 2. If the resonant frequency in the high band deviates from the desired resonant frequency, the height of the second radiation conductor plate 18 is appropriately adjusted by sliding the L-shaped top end portion 18*a* up or down. Although not shown, the length of the second radiation conductor plate 18 may be adjusted increased or decreased by adjusting the length of the L-shaped top end portion 18*a* in the direction substantially parallel to the ground conductor 20, albeit this may decrease the vertically polarized wave that emanates from the second radiation conductor plate 18 if the height of the second radiation conductor plate 18 decreases comparatively (while decreasing the overall height of the antenna).

A frequency adjusting operation for the low band will now be described in detail.

For use in the low band, a current flows in the bending flap 14*b* of the divided conductor plate 14. The cutout portion 14*c* is formed in the bending flap 14*b* to increase the path length of the current, thus allowing the resonant frequency of the divided conductor plate 14 to be shifted to the lower region. The cutaway portion 14*e* is formed at a corner of the bending flap 14*b* to reduce the path length of the current, thus allowing the resonant frequency of the divided conductor plate 14 to be shifted to the higher region. A deeper cutout portion 14*c* in the bending flap 14*b* increases the amount of frequency adjustment or shift amount.

One of the clearance holes 14*d* is selected, and the cutout portion 14*c* is formed by removing a portion of the bending flap 14*b* from the edge of the bending flap 14*b* to the selected clearance hole so as to have a cut of desired depth. This increases the inductance of the antenna by limiting the current path and thereby permits the resonant frequency for the low band to be easily and accurately shifted to the lower region. The clearance holes 14*d* for the cutaway portion 14*e* may be pre-formed in a predetermined area of the bending flap 14*b* in order to easily and accurately shift the resonant frequency for the low band to the higher region.

Removal of a portion of the bending flap 14*b* using a tool such as a router does not change the distribution of the current flowing in the main portion of the divided conductor plate 14 that is positioned at the top surface of the insulating base 11 by a large amount. Thus, even if the cutting amount or position deviates to some extent, such a deviation does not cause a large change in the resonant frequency. This allows the resonant frequency for the low band to be adjusted easily.

The bending flap 14*b* that is engaged with the insulating base 11 around the side wall thereof increases the assembly strength of the divided conductor plate 14. The bending flap 14*b* has a size large enough to sufficiently form the cutout portion 14*c* or the cutaway portion 14*e*.

A frequency adjusting operation for the high band will now be described in detail.

By sliding up the L-shaped top end portion 18*a* to extend the length of the second radiation conductor plate 18, the path length that the current travels increases, thus decreasing the resonant frequency. Conversely, by sliding down the L-shaped top end portion 18*a* to reduce the length of the second radiation conductor plate 18, the path length that the current travels is reduced, thus increasing the resonant frequency.

In the dual-band antenna 10, the L-shaped top end portion 18*a* disposed at the top end of the second radiation conductor plate 18 is bent substantially in parallel to the ground conductor 20. Due to the top-loading second radiation conductor plate 18 that serves as a monopole antenna, the height of the second radiation conductor plate 18 is greatly reduced, and the height of the overall antenna is therefore reduced.

In the dual-band antenna 10, since the pair of divided conductor plates 13 and 14 of the first radiation conductor plate 12 has the window portions 13*a* and 14*a*, the currents supplied to the divided conductor plates 13 and 14 for use in the low band flow around the window portions 13*a* and 14*a*, respectively. Thus, a desired resonant electrical length is easily maintained without increasing the size of the divided conductor plates 13 and 14. Although a meander pattern may be present to increase the length that the current travels, as shown the divided conductor plates 13 and 14 may not contain a meander pattern to achieve the desired resonant electrical length, leading to high radiation efficiency and preventing the bandwidth from being narrowed with the size reduction.

In the dual-band antenna 10, for use in the low band, currents having an equivalent magnitude are caused to flow in the opposite direction in the pair of divided conductor plates 13 and 14 of the first radiation conductor plate 12. Thus, the electric field in one of the divided conductor plates 13 and 14 is cancelled out by the electric field in the other of the divided conductor plates 13 and 14. Thus, radiation whose direction of polarization is parallel to the first radiation conductor plate 12 (horizontally polarized wave) is not substantially emitted, while radiation orthogonal to the first radiation conductor plate 12 (vertically polarized wave) is strongly emitted, resulting in high polarization purity. For use in the low band, therefore, the gain of the vertically polarized wave is greatly improved, which benefits on-vehicle communication devices considerably. The second radiation conductor plate 18 for the high band operates as a monopole antenna when excited, and the gain of the vertically polarized wave is high.

Accordingly, the dual-band antenna 10 according to this embodiment is advantageous for increasing the bandwidth as two resonance points are set for use in the low band. For use in the high band, the bandwidth is not undesirably narrowed with a reduction in size. This permits the dual-band antenna 10 to have a broader bandwidth than the frequency bandwidth used for the high and low bands, and the size of the overall antenna can be reduced without sacrificing the bandwidth. Moreover, the resonant frequency of the dual-band antenna 10 can be easily adjusted for the low band by removing a portion of the bending flap 14*b* of the divided conductor plate 14 using a tool such as a router, and the resonant frequency for the high band can also be easily adjusted by appropriately adjusting the height of the second radiation conductor plate 18. This results in high reliability without a time-consuming adjusting operation, and significantly increases the production yield.

In the above-described embodiment, the cutout portion 14*c* or the cutaway portion 14*e* is formed in the bending flap 14*b* of the divided conductor plate 14 in order to adjust the resonant frequency for the low band. A similar cutout or cutaway portion formed in an area other than the bending flap 14*b* of the divided conductor plate 14 or any area of the divided conductor plate 13 continuously formed with the feed conductor plate 15 allows a similar frequency adjustment. In this case, however, if the cutting amount or position is slightly deviated, depending on the location of the cutout or cutaway portion, the resonant frequency can be changed to a larger extent. This increases the amount of care to perform the cutting operation compared to the above-described embodiment.

In the above-described embodiment, the pair of divided conductor plates 13 and 14 has the window portions 13*a* and 14*a*. Other embodiments do not contain window portions, achieving similar advantages.

In the above-described embodiment, the first radiation conductor plate 12 is composed of the pair of divided conductor plates 13 and 14 that are formed side-by-side with the slit S therebetween. However, the first radiation conductor plate 12 may be an undivided conductor plate with which the opening end 11*a* of the insulating base 11 is completely covered.

In addition, although only a dual-antenna has been described, similar concepts are extendable to a multiple frequency antenna in which three or more resonant frequencies exist. Another vertically or horizontally polarized wave can be used (or a combination thereof) with a similar arrangement as the high and/or low band structures provided herein. The frequency ranges for the high or low band structures may include but are not limited to GSM 900 MHz, 1.8 GHz, 1.9 GHz, 2.4 GHz, other 802 frequencies, etc.

Although only a few exemplary embodiments of this invention have been described in detail above, those skilled in the art will readily appreciate that many modifications are possible in the exemplary embodiments without materially departing from the novel teachings and advantages of the invention. Accordingly, all such modifications are intended to be included within the scope of this invention as defined in the following claims.

What is claimed is:

1. An antenna comprising:

a support board having a ground conductor formed thereon;

an insulating base disposed on the support board, the insulating base having an opening end and an internal space;

a first radiation conductor plate disposed such that an opening end is covered with the first radiation conductor plate, the first radiation conductor plate having a bending flap that is bent from the opening end of the insulating base towards a side wall of the insulating base, the bending flap having at least one of a cutaway portion that reduces a current path length and a cutout portion that increases the current path length, the first radiation conductor plate having a first resonant frequency;

a feed conductor plate having a first end connected with the first radiation conductor plate;

a first short-circuiting conductor plate having a first end connected with the first radiation conductor plate and a second end connected with the ground conductor; and a second radiation conductor plate disposed in the internal space of the insulating base so as to be connected with a second end of the feed conductor plate, the second radiation conductor plate having a second resonant frequency higher than the first resonant frequency.

2. The antenna according to claim 1, wherein the first radiation conductor plate contains a window portion around at least a portion of which the bending portions are disposed.

3. The antenna according to claim 1, wherein the cutout portion contains a plurality of clearance holes that provide markers for cutting out different amounts of the bending flap.

4. The antenna according to claim 3, wherein the clearance holes are disposed different distances from a lower edge of the bending flap.

5. The antenna according to claim 1, wherein the cutout portion is disposed substantially in a center of one side of the bending flap.

6. The antenna according to claim 1, wherein the cutaway portion is disposed at a corner of the bending flap.

7. The antenna according to claim 1, wherein the second radiation conductor plate comprises a first section connected with the second end of the feed conductor plate and substantially perpendicular to the ground conductor and a movable second section attached to the first section.

8. The antenna according to claim 7, wherein the second section is movable to change a length of the second radiation conductor plate.

9. The antenna according to claim 8, wherein the second section contains a portion that is substantially parallel with the ground conductor.

10. The antenna according to claim 9, wherein the second section forms substantially an L shape.

11. The antenna according to claim 1, wherein the first radiation conductor plate further comprises a top portion that substantially parallel with the ground conductor and from which the bent flap extends.

12. The antenna according to claim 1, wherein the first radiation conductor plate is attached to the insulating base.

13. The antenna according to claim 1, wherein the first radiation conductor plate comprises a plurality of conductor plates separated by a slit.

14. The antenna according to claim 13, wherein each of the plurality of conductor plates is substantially rectangular.

15. The antenna according to claim 13, wherein the bending flap only extends along a periphery of the opening end of the insulating base.

16. The antenna according to claim 13, further comprising a second short-circuiting conductor plate, the first and second short-circuiting conductor plates connected with different conductor plates of the first radiation conductor plate.

17. The antenna according to claim 16, wherein the first and second short-circuiting conductor plates are disposed adjacent to the slit.

18. The antenna according to claim 16, wherein the first and second short-circuiting conductor plates are disposed diagonal to each other and do not overlap each other in a width direction of the antenna.

19. The antenna according to claim 16, wherein feed conductor plate is disposed more proximate to the second short-circuiting conductor plate than the first short-circuiting conductor plate is to the second short-circuiting conductor plate.

20. The antenna according to claim 16, wherein the feed conductor plate and second short-circuiting conductor plate are disposed diagonal to each other and do not overlap each other in a width direction of the antenna.

21. The antenna according to claim 1, wherein the insulating base is disposed on the opposite side of the support board as the side on which the ground conductor is formed.

22. A method for adjusting a resonant frequency of an antenna, the antenna comprising:

a support board having a ground conductor formed thereon;

an insulating base disposed on the support board, the insulating base having an opening end;

a first radiation conductor plate covering the opening end of the insulating base, the first radiation conductor plate having a first resonance frequency;

a feed conductor plate having a first end connected with the first radiation conductor plate;

a short-circuiting conductor plate having a first end connected with the first radiation conductor plate and a second end connected with the ground conductor; and a second radiation conductor plate disposed in an internal space of the insulating base so as to be connected with the second end of the feed conductor plate, the second radiation conductor plate having a second resonance frequency higher than the first resonance frequency, the method comprising cutting a portion of the first radiation conductor plate to form at least one of a cutaway portion that reduces a current path length and a cutout portion that increases the current path length, thereby changing the first resonant frequency.

23. The method according to claim 22, wherein the first radiation conductor plate has a bending flap that is bent from the opening end towards a side wall of the insulating base, and the method further comprising cutting the bending flap to form the at least one of the cutaway portion and the cutout portion.

24. A method according to claim 23, wherein the bending flap extends along a periphery of the opening end and is engaged with the insulating base around the side wall.

25. A method according to claim 23, the method further comprising using a plurality of clearance holes in the bending flap to define an amount by which the bending flap is cut to form the at least one of the cutaway portion and the cutout portion.

26. An antenna comprising:

a ground conductor;

a plurality of conductors having resonances at different frequencies, a first of the conductors having at least one of a cutaway portion and a cutout portion, and a second of the conductors having an adjustment portion that permits reversible adjustment of a current path length of the second conductor, each of the cutaway and cutout portions permitting non-reversible adjustment of a current path length of the first conductor;

a feed conductor connected with the conductors; and a first short-circuiting conductor connected with the ground conductor and at least one of the conductors.

27. The antenna according to claim 26, wherein the cutaway, cutout and adjustment portions permit adjustment of the current path length of the respective conductor without substantially altering the current path length of other conductors.

28. The antenna according to claim 26, wherein the cutaway and cutout portions are disposed at positions that do not substantially affect a distribution of current flowing in a main portion of the first conductor.

29. The antenna according to claim 28, wherein the cutaway portion is disposed at a corner of the first conductor and the cutout portion is disposed at a position other than at the corner of the first conductor.

30. The antenna according to claim 26, wherein the first conductor contains a window portion devoid of conductive material around which the at least one of the cutaway and cutout portions is disposed.

31. The antenna according to claim 26, wherein the first conductor comprises a first section substantially parallel with the ground conductor and a second section that contains the at least one of the cutaway and cutout portions and is substantially perpendicular to the ground conductor.

32. The antenna according to claim 26, wherein the second conductor comprises multiple sections, at least one of the sections movably attached to another of the sections.

33. The antenna according to claim 32, wherein one or more of the sections contains a portion that is substantially parallel with the ground conductor and one or more of the sections contains a portion that is substantially perpendicular to the ground conductor.

34. The antenna according to claim 26, wherein the first conductor comprises multiple separated conductors.

35. The antenna according to claim 34, further comprising a second short-circuiting conductor connected with the ground conductor, each of short-circuiting conductors connected with a different conductor of the first conductor.

36. The antenna according to claim 35, wherein the feeding conductor is connected to fewer than all of the multiple conductors.

37. The antenna according to claim 36, wherein the feeding conductor is connected with a first of the multiple conductors of the first conductor and is not connected to a second of the multiple conductors of the first conductor, the feeding conductor is disposed proximate enough to the short-circuiting conductor connected to the second of the multiple conductors to permit electromagnetic coupling to causes a substantial induced current to flow in the second short-circuiting conductor when the feed conductor is fed.

38. The antenna according to claim 34, wherein each of the multiple separated conductors have the same shape.

* * * * *